US010734145B2

(12) United States Patent
Bjarnasen et al.

(10) Patent No.: US 10,734,145 B2
(45) Date of Patent: Aug. 4, 2020

(54) OPTIMAL INDUCTOR

(71) Applicant: Comsys AB, Lund (SE)

(72) Inventors: Oscar H. Bjarnasen, Lund (SE); Tord Cedell, Bjärred (SE)

(73) Assignee: Comsys AB, Lund (SE)

( * ) Notice: Subject to any disclaimer, the term of this patent is extended or adjusted under 35 U.S.C. 154(b) by 94 days.

(21) Appl. No.: 14/419,516

(22) PCT Filed: Sep. 10, 2013

(86) PCT No.: PCT/EP2013/068682
§ 371 (c)(1),
(2) Date: Feb. 4, 2015

(87) PCT Pub. No.: WO2014/040973
PCT Pub. Date: Mar. 20, 2014

(65) Prior Publication Data

US 2015/0228390 A1 Aug. 13, 2015

(30) Foreign Application Priority Data

Sep. 14, 2012 (EP) ..... 12184479

(51) Int. Cl.
*H01F 27/28* (2006.01)
*H01F 27/02* (2006.01)
(Continued)

(52) U.S. Cl.
CPC ..... *H01F 5/06* (2013.01); *H01F 3/08* (2013.01); *H01F 5/00* (2013.01); *H01F 17/04* (2013.01);
(Continued)

(58) Field of Classification Search
CPC ..... H01F 5/06; H01F 27/2823; H01F 27/32; H01F 41/0654; H01F 41/0246
(Continued)

(56) References Cited

U.S. PATENT DOCUMENTS 3,348,183 A * 10/1967 Hodges ..... H02K 15/045 29/596
3,617,965 A * 11/1971 Trench ..... H01F 27/025 336/211
(Continued)

FOREIGN PATENT DOCUMENTS

JP 5996605 A 6/1984
JP 2004525505 A 8/2004
(Continued)

OTHER PUBLICATIONS

International Search Report for PCT/EP2013/068682, ISA/EP, dated Dec. 18, 2013.

*Primary Examiner* — Elvin G Enad
*Assistant Examiner* — Kazi Hossain
(74) *Attorney, Agent, or Firm* — Capitol City TechLaw

(57) ABSTRACT

The present invention relates to a coil (1) for an inductor (6), comprised by metal wire (2) wound circular around a centre axis (C), wherein the wire has an electrically insulating layer (3) insulating each turn of the wire in the winding from neighbouring turns, the shape of the complete winding, building up the coil (1), is substantially toroidal having a substantially elliptic cross section, wherein the thermal heat conductivity is above 1 W/m*K more preferably above 1.2 and most preferably above 1.5. The invention further relates to a magnetic core (7) suitable for an inductor (6), where in the core is made of a soft magnetic composite material made of metallic particles and a binder material, said particles are in the range of 1 μm-1000 μm, particles that are larger than 150 μm are coated with a ceramic surface to provide particle to particle electrical insulation, wherein the volume of magnetic, metallic particles to total core volume is 0.5-0.9. The invention still further relates to an inductor (6) being a combination of said coil (1) and core (7), wherein the substantially all of said particles in the core are magnetically
(Continued)

aligned with the magnetic field of the coil. The invention still further relates to the manufacturing methods of such a coil (1) and core (7).

8 Claims, 3 Drawing Sheets

(51) Int. Cl.

| | |
|---|---|
| ***H01F 17/04*** | (2006.01) |
| ***H01F 27/30*** | (2006.01) |
| ***H01F 5/06*** | (2006.01) |
| ***H01F 3/08*** | (2006.01) |
| ***H01F 5/00*** | (2006.01) |
| ***H01F 27/255*** | (2006.01) |
| ***H01F 41/02*** | (2006.01) |
| ***H01F 41/12*** | (2006.01) |
| ***H01F 41/073*** | (2016.01) |
| ***H01F 27/32*** | (2006.01) |

(52) U.S. Cl.
CPC ..... *H01F 27/255* (2013.01); *H01F 27/2823* (2013.01); *H01F 27/2876* (2013.01); *H01F 27/32* (2013.01); *H01F 41/0246* (2013.01); *H01F 41/0273* (2013.01); *H01F 41/073* (2016.01); *H01F 41/12* (2013.01); *Y10T 29/49071* (2015.01)

(58) Field of Classification Search
USPC ..... 336/222, 221, 213, 83
See application file for complete search history.

(56) References Cited

U.S. PATENT DOCUMENTS 3,648,209 A 3/1972 Conger
3,772,454 A * 11/1973 Donecker ..... D07B 1/147 174/102 E
4,471,337 A * 9/1984 Mausz ..... H01F 27/2823 336/180
4,546,210 A * 10/1985 Akiba ..... H01B 7/303 174/114 R
4,652,771 A * 3/1987 Specht ..... H01F 30/16 307/416
4,684,882 A * 8/1987 Blain ..... H01F 30/10 323/356
5,164,626 A * 11/1992 Oigawa ..... F24H 1/225 310/208
6,437,249 B1 8/2002 Higashiura et al.
2002/0021201 A1* 2/2002 Ol ..... H01F 3/14 336/197
2002/0033748 A1* 3/2002 Bolotinsky ..... H01F 30/16 336/182
2002/0050395 A1* 5/2002 Kusumoto ..... H02K 3/12 174/128.2
2002/0097124 A1 7/2002 Inoue et al.
2002/0117320 A1* 8/2002 Hyogo ..... H01F 5/06 174/68.1
2003/0030529 A1* 2/2003 Min ..... H01F 3/14 336/182
2004/0074564 A1 4/2004 Brunner
2004/0183639 A1* 9/2004 Okura ..... H01F 27/2823 336/180
2006/0145801 A1* 7/2006 Adar ..... H01F 3/06 336/175
2006/0176140 A1 8/2006 Skendzic et al.
2006/0202790 A1* 9/2006 Buswell ..... H01F 3/14 336/229
2007/0290161 A1 12/2007 Tokuoka et al.
2008/0006435 A1* 1/2008 Scheel ..... C09J 7/0282 174/113 R
2009/0278647 A1* 11/2009 Buswell ..... H01F 3/06 336/182
2010/0219928 A1 9/2010 Alakula
2011/0043190 A1 2/2011 Farr
2011/0090035 A1* 4/2011 Kikuchi ..... H01F 17/02 336/189
2011/0109419 A1* 5/2011 Cooper ..... H01F 5/06 336/206
2012/0070567 A1 3/2012 Watanabe et al.

FOREIGN PATENT DOCUMENTS

JP 2005510049 A 4/2005
WO 02059914 A2 8/2002
WO 2007010988 A1 1/2007
WO 2009051057 A1 4/2009

* cited by examiner

OPTIMAL INDUCTOR

CROSS-REFERENCE TO RELATED APPLICATIONS

This application is a 371 U.S. National Stage of International Application No. PCT/EP2013/068682, filed Sep. 10, 2013, which claims priority to European Patent Application No. 12184479.9, filed Sep. 14, 2012. The disclosures of the above applications are incorporated herein by reference.

TECHNICAL FIELD

The present invention relates generally to an optimal inductor design. More particularly, the present invention relates to a coil for an inductor as defined in the introductory parts of claim 1, a core for an inductor as defined in the introductory parts of claim 6, and an inductor comprising that coil and that core as defined in the introductory parts of claim 8. The invention further relates to a method for producing said coil and said core.

BACKGROUND ART

With the ever growing power electronics industry, inductors have become increasingly important in applications such as power generation, power quality, AC drives, regenerative drives etc. Inductors are often key components in the equipment used and often determine the efficiency and performance of the equipment in question. An especially problematic area has been in applications where the inductor must handle at the same time a fundamental frequency of e.g. 50 Hz while at the same time filter away from the final signal higher frequencies generated by i.e. switch mode power supplies. Similarly, power electronics often give source to harmful harmonic distortions which have become one of the greatest concerns for the power quality industry today.

Conventional inductors are normally produced by either winding wire on a coil former, in air or to an iron (solid, laminated or ferrite) core. The wire is then wound around the core which often has an air gap to control the permeability in order not to saturate the core material. This gives source to magnetic leak flow, energy losses and heating of the surrounding metal. If the coil is wound over the air gaps there will often be considerable fringing losses, resulting in a hot-spot which can be hard to cool. Inductors furthermore usually have standardized coil formers, conductors and core material. This inevitably leads to limitations in design freedom resulting in ineffective and un-optimized inductor designs.

A first step towards an elimination or alleviation of the above problems has emerged during the last decade, with the birth of a new material technology. This new material technology provides greater possibilities to specially adapt; optimize and integrate these types of actuators in consumer products as well as industrial products. The material technology in question is composites of soft magnetic metallic materials with varying amount of binder and filler, named Soft Magnetic Composites, SMC. The forming of these components made of SMC is of great interest, since the demands on high metal packing ratio and design freedom are in conflict with the known manufacturing methods especially from a production cost perspective. A successful forming process will result in an inductive component, which in many ways is superior to conventional ones in terms of lower losses, smaller size, resulting in a more compact integration in the final device/product.

In addition, many problems are still present with inductors depending on the material choices in terms of energy losses, heat and hot-spot problems, annoying sound, caused by high currents at audible frequencies, unnecessary and ineffective material usage, lower efficiency at higher frequencies, and saturation at low flux intensity, etc.

The use of inductors in the industry is ever increasing, and the demands for higher performing inductors increase with the demand. High performing inductors are also relatively expensive. There is thus a need for a new and improved inductor having improved performance with regard to the problems presented above. The enhanced performance of improved inductors should preferably be implemented in a cost effective way.

SUMMARY OF THE INVENTION

It is an object of the present invention to improve the current state of the art, to solve the above problems, and to provide an improved inductor with improvements to both its coil and core. These and other objects are achieved by a coil comprised by a metal wire wound circular around a centre axis (C), wherein the wire has an electrically insulating layer insulating each turn of the wire in the winding from neighbouring turns, the shape of the complete winding, building up the coil, is substantially toroidal having a substantially elliptic cross section, and has a bulk thermal heat conduction of above 0.8 W/m*K.

The thermal heat conduction and shape is achieved by compression means which reduces substantially air or gas voids present in the coil, reducing energy losses and increases the compactness of the coil. The coils compactness in combination with the toroidal shape increases the H-field of the coil which is especially important for smaller inductors where an adequate H-field is preferable to generate the required flux in the core material.

The coil having the toroidal shape is preferably a ring torus having a substantially circular cross section. This is further a step of optimizing the magnetic field per weight and size of the coil used.

The coil should further preferably have a thermal heat conductivity above 1 W/m*K more preferably above 1.2, still more preferable above 1.5 and most preferably above 2. The higher thermal conductivity is achieved, inter alia, by having a high metal volume to total volume in the wound coil, also called fill factor, and by reducing air and gas voids, replacing them with for example insulation material and resin with higher thermal conductivity than air or gas, while still having a sufficient electrical insulation between each turn in the winding. The high thermal conductivity is needed so that the heat generated by losses in the coil under operation can easily reach the outer surface of the coil and finally the outer surface of the inductor. A lower coil temperature is not only beneficial for the overall performance of the coil but necessary for achieving greater efficiency performance as well as for preserving the properties of the insulation materials thus increasing its life time. To achieve a high fill factor the cross section of the wire of the winding at each position is preferably shaped to fit tightly to adjacent turns of the wire in the winding, reducing substantially hollow voids in the winding. By avoiding voids in the winding, the risk of partial discharge dielectric breakdown is heavily reduced. The shape of the cross section of each individual wire within the coil may advantageously be hexagonal as this is a natural shape when compressing multiple circular wires lying tightly adjacent each other as is the case when winding a circular wire and compressing it to remove air or gas voids. This is with the exception of the external wire layer which is optimally shaped after the round external shape of the complete coil, seen in a cross sectional view. The conducting material used for the coil may be any material suitable to use for a coil, preferably copper or aluminium.

The insulating layer insulating wire parts from adjacent wire parts, i.e. insulating a wire turn from the next wire turn, is preferably a material made of electrical insulating paper and/or resin. An insulating paper may be wound around the wire and impregnated from within by semi-cured or half-baked resin existing on the wire and/or its strands as explained below. The resin is then hardened by e.g. heat. The insulating layer may, however, be any suitable electrically insulating material that is insulating enough to be able to make the layer thin while still preserving sufficient dielectric and capacitive turn to turn insulation.

The wire can consist of one or more separately electrically insulated strands depending on the total current and its frequency. With smaller diameter strands the skin effect related losses will be reduced.

The cross section of each strand at each position is shaped to fit tightly to adjacent strands, reducing voids in the wire, which is important for optimizing the H-field and the thermal conductivity of the coil. Also this cross-section, as for the wire as a whole, is preferably hexagonal, as is natural when compressing strands of circular cross section to eliminate any gaps in between. This is with the exception of the external strand layer which is optimally shaped after the external shape of the complete wire.

In cases where the wire building up the coil comprises multiple strands the bundle of strands are optimally twisted approximately 360°±90° for the complete wound coil thus greatly reducing proximity effects caused in the coil by higher frequencies. By using the above mentioned essentially parallel strands a simple litz wire is accomplished in a cost effective manner. The strands are preferably electrically insulated by cured resin and semi-cured resin as explained below. The electrical insulation is very thin compared to the cross section of a strand and may be a thin polymer coating, a thin layer of resin etc. As each strand has similar, optimally equal, potential the insulation does not have to be very thick.

By using one or more semi-cured resin layers on the strand insulation, it is possible to cure the resin in the coil forming tool and subsequently maintain the optimal shape of the coil after de-moulding it from the tool. The coil is first heated up to a necessary temperature level in order to sufficiently harden the semi-cured resin layer/s on the strands. The semi-cured resin also flows into air cavities from within the coil reducing hotspots in the coil, enhancing heat conducting properties. The semi-cured resin furthermore enhances the dielectric and capacitive leakage properties of the exterior electrical insulation paper that may be used surrounding each complete wire.

On the exterior of the coil, a third insulation layer should be attached in order to further enhance the electrical insulation to the soft magnetic core material that will be moulded on the coil. It is important that this insulation secures that no core particles are in direct contact with the conducting material to avoid dielectric short circuiting either between wires or from the coil to the core material. To achieve this goal impregnation of electrically insulating resin material is preferable. This third insulation layer also secures an even or smooth outer surface so that localized high intensity B-flux, creating hot spots, are avoided. It further reduces the capacitive leakage to the soft magnetic core and the ground if the core material is grounded.

The objects of this invention are further achieved by a magnetic core, e.g. for an inductor, wherein the core is made of a soft magnetic mouldable composite (SM2C) material made of metallic particles and a binder material, said particles are in the range of 1 μm-1000 μm, where a certain part of the particles, i.e. larger than 150 μm, are coated with a ceramic surface to provide particle to particle electrical insulation, wherein the metal packing ratio of magnetic, metallic particles to total core volume is 0.5-0.9.

The core is possible to mould and is therefore suitable for having a coil incorporated in it. The moulding process makes it possible to achieve a good thermal coupling between the core and the coil by avoiding air or gas voids between coil and core. The binder material can be a polymer, e.g. epoxy or a ceramic based binder. The core having said metal volume packing ratio will have good heat conduction properties and high bulk resistivity due to the particle to particle insulation. The particle to particle insulation also enhances the high frequency properties. Since the core is moulded any shape of the core may be created.

It is further preferred that the particles are in the range of 10 μm-800 μm, further optimizing the core properties and increasing its magnetic properties. The size chosen depends to some extent to the intended use of the core. Smaller particles give better high-frequency properties of the core.

The metallic particles may have a composition consisting of: 6, 5%-7, 5% Si, preferably 6, 8%-7% Si, and remaining particles consisting of Fe. The powder may be produced through gas atomization, giving it an almost spherical particle shape. The metallic particles may also have a composition consisting of: 8%-10% Si, preferably 9% Si; 5%-7% Al, preferably 6% Al; and remaining particles consisting of Fe.

It is a further object of the present invention to provide a method of producing the magnetic core comprising the steps of: placing the soft magnetic composite material made of metallic particles and a binder material in a mould, and arranging a magnetic field in the mould during the moulding and/or hardening phase of the material, magnetically aligning the core particles with the H-field. The magnetic field is preferably achieved during production by placing a coil in the mould and run a current through the coil. The important feature for the core is that the particles in the SM2C material are aligned with the H-field of the intended use of the core. The magnetic field that the core is produced for is therefore preferably used, i.e. in case an inductor is manufactured a coil is preferably used for inducing the magnetic field during manufacturing. If the core is used for a different application, the magnetic field may be induced by other means.

The objects of the present invention are further achieved by an inductor wherein the coil described above is embedded in a core as described above, wherein the coil has an electrically insulating layer covering its surface area, and substantially all of said particles in the core are magnetically aligned with the H-field produced by the coil.

Combining the improved coil as described above, with the improved core as described above, results in an optimal design of an inductor. The coil is optimally shaped and constructed and can be matched by an optimally shaped core, since the core may be moulded in any shape. The optimal shape for the core is a toroidal shape covering the coil. The B-flux is then evenly distributed and losses due to higher intensity flux are reduced. Additionally, the core material is optimally used removing excess material which affects the size and weight of the inductor. The absence of voids in the design, creating a direct thermal coupling between core and coil, is a further reason for avoiding hot spots in the core material, while at the same time optimizing heat conduction, leading heat from the coil and core to the ambient environment surrounding the inductor.

Having the particles in the core aligned with the H-field that is induced by current flowing through the coil, further enhances the performance of the inductor, increasing the permeability and reducing losses. Magnetically aligned particles are achieved by running a current through the coil before and/or during the cores moulding and hardening phase. The magnetic field induced by the coil will cause forces on the particles in the core so that they align with the magnetic field.

It is further preferred that the coil is arranged in an optimal position to provide substantially the same B-flux in the core material in all directions seen from the coil surface (the same volume in all directions), by having substantially the same cross sectional area of the core on the inside of the coil towards the centre axis as on the outside of the core, seen in a cross section along a plane perpendicular to the centre axis (C) through the centre of the coil. The core material will then have an even and homogenous B-flux, which optimizes the loss properties in the material. Additionally, the core material is optimally used removing excess material which affects the size and weight of the inductor. The distance from the coil to the radial outer edge of the core (in a direction perpendicular to the coinciding central axis of the toroidal shape of the core and coil) is smaller than the distance from coil to the radial inner edge of the core, to provide the same core volume on the radial inner side of the coil as on the outer side.

The coil may further be offset from said optimal position to provide a higher magnetic flow towards the centre of the inductor from the coil than towards the periphery of the inductor. This reduces stray fields generated by the inductor and also reduces the demand for small mechanical tolerances during manufacturing of the inductor. The core may further comprise surface increasing structures modifying the substantially toroidal shape to increase the surface area. The surface increasing structures may be fins or ripples on the surface of the core making the core outer surface into a heat sink. A further aspect of the present invention is a method of producing a coil according to the above described coil is presented, comprising the steps of applying the insulating layer to the wire, winding the wire around the centre axis (C), compressing the winding to a ring torus shape having a circular cross section using compression means, insulating the total coil externally with electrical insulation paper and impregnating the total coil with electrical insulation resin. Compressing the wire will conform the wire thereby filling voids in the winding, increasing the performance of the inductor. The compression may further lead to plastic deformation of the conducting material. The conforming of the wire together with the plastic deformation makes it possible to shape the coil into preferred form and gain desired heat conduction. The winding is preferably compressed using an isostatic pressure of more than 65 MPa to substantially remove voids in the coil and gain the desired shape.

A current may further be applied to the wire during said compression. The heat resulting from the current flowing through the coil will cure the half-baked resin layers on the wire insulation enabling a maintained optimal coil shape after the compression stage. The half-baked resin also acts to enhance the electrical insulation properties of the electrical insulation paper that may be placed on each wire.

A further aspect of this invention is a method of producing a magnetic core where current is run through the coil, before and/or during the moulding and/or hardening phase of the material, magnetically aligning the core particles with the H-field of the coil. This alignment further enhances the performance of the inductor, increasing the permeability and reducing losses.

The inductor manufactured with an essentially torus shaped coil within a mouldable SM2C (Soft Magnetic Mouldable Composite) has many advantages.

With a mouldable soft magnetic core, the geometric properties can be optimal with respect to the soft magnetic core permeability. The greatest technical benefit of this design is that it leads to a near theoretically optimal flux path for the electromagnetic field in the inductor avoiding unnecessary corners or angles which create hotspots reducing the life time of the insulation material and create losses in the inductor. It is further a compact and homogenous design with great heat distribution and dissipation properties. The torus shape of the coil also leads to the highest degree of induction for a given core material properties as corners or angles lead to localized saturation. The high degree of compactness of the torus shaped coil, as described above, further increases the H-field considerably enabling for a considerably smaller inductor reducing materials needed resulting in a smaller, lighter, more cost effective units with great heat conductivity.

The use of the SM2C core material is a crucial part of the invention. It allows in a simple production step to form/create the optimal torus shape of the core avoiding unnecessary material outside the flux path. The direct thermal coupling between the coil and the core material achieved by moulding the material directly on the surface of the insulated coil enables the heat losses generated in the winding to easily be distributed to the outer surface of the inductor where they can be cooled away. In the moulding step it is furthermore simple to create cooling fins or ripples to further increase the cooling properties of the inductor when needed.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

Figure 1:
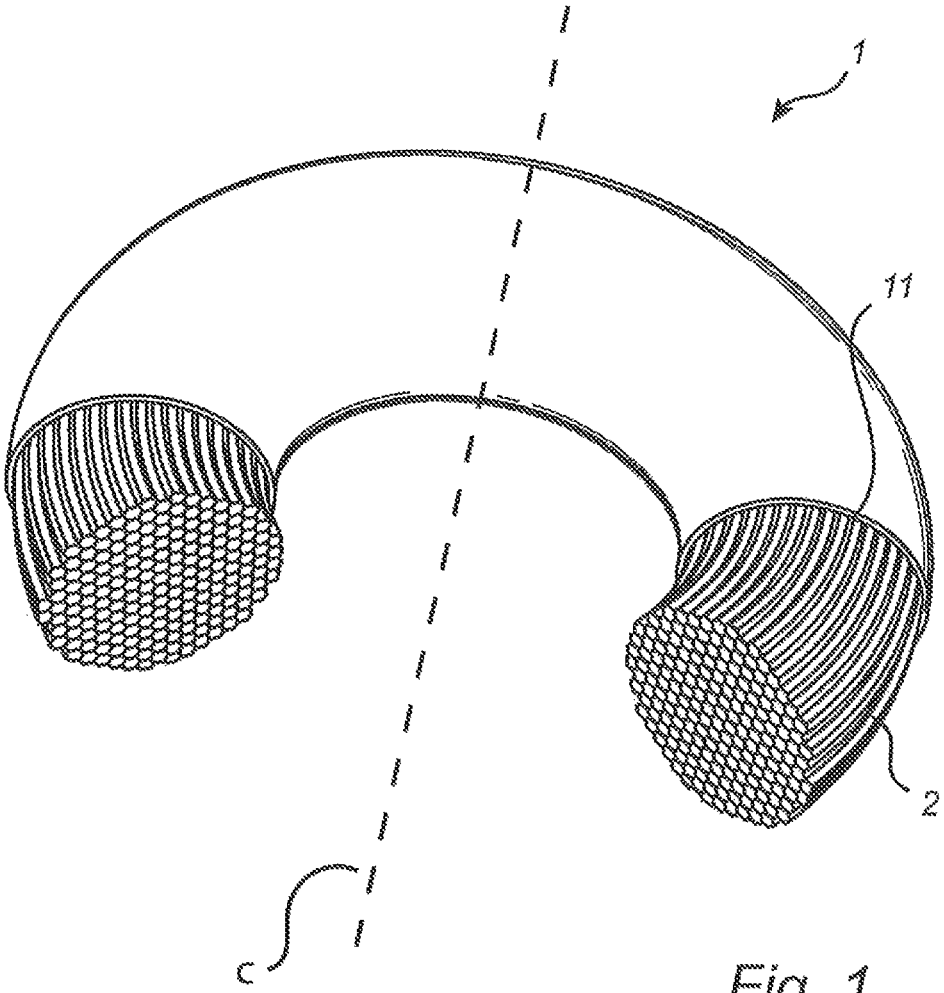
FIG. 1 is a perspective view of a coil for an inductor.
Figure 2A:
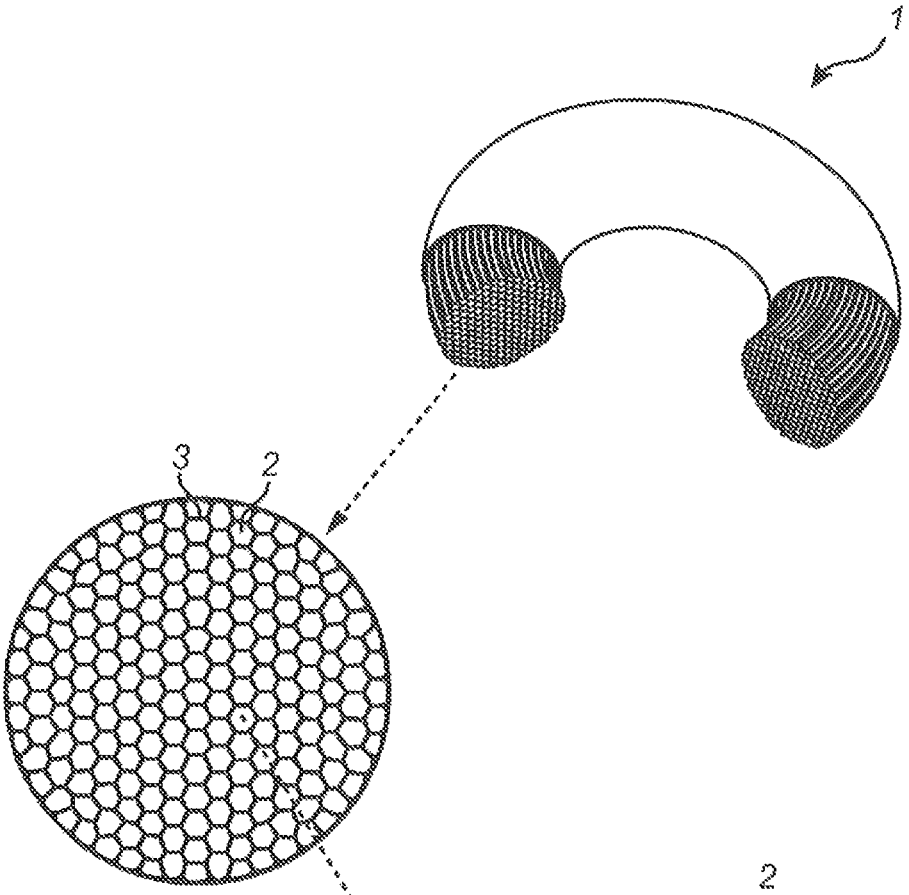
FIG. 2*a* is a cross sectional view of the coil in FIG. 1.
Figure 2B:
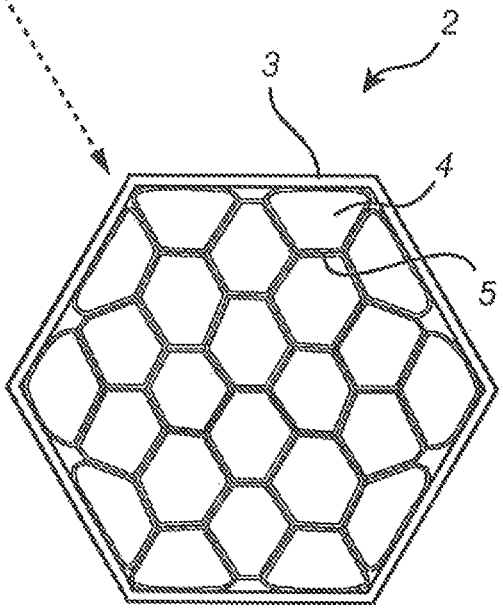
FIG. 2*b* shows an enlarged view of the cross sectional view of FIG. 2*b* showing the strands of the wire.

FIG. 1 shows a perspective view of a coil 1 for an inductor. The coil 1 is torus shaped and is built up by a wounded wire 2, better seen in the cross section of the coil shown in FIG. 2*a*. The coil is coated or wound with an insulated layer 11. In FIG. 2*a* it can be seen how the wire 2 has an insulating layer 3, and how the wire laps in the coil 1 have been compressed so that the shape of each inner wire lap is hexagonal, filling substantially all space, so that voids are reduced substantially. FIG. 2*a* further shows how the external wire layer of the coil is formed after the desired toroidal shape of the total coil so that the external wire layer follows the smooth toroidal torus shape of the coil 1. FIG. 2*b* shows an enlarged view of the cross sectional view of FIG. 2*a* showing the strands 4 of the wire 2. The strands 4 of the wire 2 are coated with a thin layer 5 of e.g. a polymer or resin to insulate the strands from one another.

Figure 3:
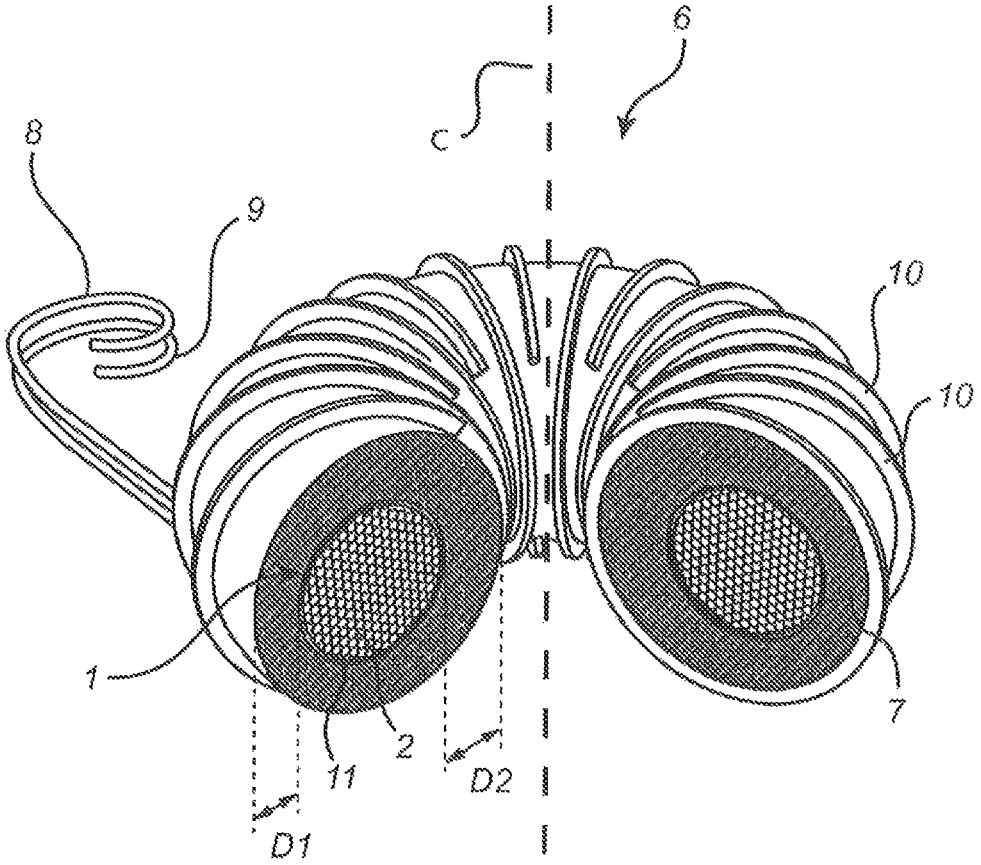
FIG. 3 is a perspective view of an inductor including a coil according to FIG. 1 and FIG. 2, integrated in a core according to the present invention.

FIG. 3 is a perspective view of an inductor 6 including a coil 1 according to FIG. 1 and FIG. 2*a, b*, integrated in a core 7 according to the present invention. The ends 8, 9 of the wire that is wound to the coil 1 can be seen. These ends 8, 9 are used for connecting the inductor during operation of the inductor. The core 7 has a surface that is formed to a heat sink 10, to increase the surface are and thereby increase the heat sinking capabilities of the inductor. It is also visible in FIG. 3 that the distance from the coil is not centred in the core, seen in a cross section of the core. The distance D2 of core material from the coil to its central end is longer than the distance D1 from the coil to the peripheral edge of the core. Thereby substantially the same volume of core material is present on the centre side of the coil as on the outside of the coil (away from the central axis of the inductor).

The invention will now be described in detail to explain the function of the optimal inductor design.

Coil

The coil comprises of separately insulated strands of e.g. copper or aluminium. The electrical insulation on each strand is very thin compared to the total cross-sectional area of the strand and can consist of for example a thin polymer coating. This enables a high fill factor of conducting material while maintaining low skin effect losses at high frequencies.

The strands, put together, will form a wire. The wire can consist of one strand or many strands depending on, inter alia, the total current and its frequency content. With smaller diameter strands the skin effect related losses and the proximity effect losses will be reduced.

By putting all strands in parallel and then twisting the package with approximately one complete turn (360 degrees, ±90°) per coil the proximity effect will be substantially reduced. However when the strands are turned too much that will negatively affect the wire's fill factor and create possible damages to the insulation coating in cases where pressure is applied to the coil.

An electrically insulating layer must be attached around each complete wire. The insulating layer on the wire must be tough enough to withstand mechanical pressures as will be the result when the wire is wound to form a multi-turn, torus shaped, coil. This material prevents dielectric short circuiting between wires and prevents capacitive leakage from wire to wire. To further extend the properties of the coil, especially the heat conduction and the conducting materials fill factor, the coil can be compressed. By using one or more semi-cured resin layers on the strand insulation, it is possible to cure the resin in the coil forming tool and subsequently maintain the optimal shape of the coil after de-moulding it from the tool. The coil is heated, e.g. by running a high current through the coil, so that semi-cured resin will flow into air cavities between strands and wires, enhancing heat conductivity and dielectric and capacitive leakage properties.

A further third insulation layer 11 is also attached to the exterior of the coil to insulate the coil from the outside environment, in this embodiment a moulded core. This ensures that the insulating layer is covering all of the coil, a resin is used in the insulating layer. The resin will also make the outside surface of the coil smooth, following the torus shape of the coil and adapting well with its magnetic field, thereby avoiding hotspots.

Soft Magnetic Core

The soft magnetic core that is moulded around the coil is also essentially torus shaped. The shape of the core can also be equipped with e.g. mounting holes and heat flanges, see FIG. 3.

The essentially torus shape of the core has the benefit from existing technologies of optimally utilizing the exact amount of core material, removing any unnecessary excess material which is not necessary/needed for the coils flux path and the optimal function of the inductor. This reduces material costs as well as the weight and size needed for the inductor.

The permeability of the SM2C can be adjusted to adapt to the design. By running current through the coil, during the moulding and hardening phase of the material, it is possible to enhance its permeability by 10-15%. The H-field of the coil then optimally aligns the surrounding powder particles in the same or similar direction as the flux path of each individual unit. Maintaining the current during hardening ensures that the particles maintain their altered and optimized position. This creates an easier path for the flux to run through which increases the inductance and decreases the inductors losses.

The core would preferably be placed in an axially symmetrical fashion so that the area of the core material, perpendicular to the flux lines, is more or less the same in all parts of the inductor.

The particle size distribution is chosen to provide a good packing of the powder in combination with optimized static and dynamic magnetic properties.

To avoid particle-to-particle electrical conduction in the core, the particles are coated with a thin insulating layer before the moulding process. The insulating layer may e.g. be made of ceramic Nano-particles, which enhances the bulk resistivity of the moulded core and thus reduces the high frequency induced eddy currents.

The invention claimed is:

1. A coil for an inductor, the coil comprising:

a metal wire wound circular around a center axis;

wherein the wire has an electrically insulating layer insulating each turn of the wire in the winding from neighboring turns;

wherein the wire includes a plurality of electrically insulated strands that are twisted 360°, ±90°, for the complete wound coil;

wherein the shape of the complete winding, building up the coil, is toroidal having an elliptic cross section in a plane perpendicular to the wire winding direction; and wherein the wound coil has a metal volume to a total volume at a level so that the thermal heat conduction of the coil is above 0.8 W/m*K.

2. The coil according to claim 1, wherein the toroidal shape is a ring torus having a circular cross section.

3. The coil according to claim 1, wherein the strands are electrically insulated by cured resin or cured and semi-cured resin.

4. The coil according to claim 1, wherein the cross section of each strand at each position is shaped to fit tightly to adjacent strands, reducing voids in the wire.

5. An inductor comprising a coil according to claim 1, wherein the coil is embedded in a core;

wherein the core is made of a soft magnetic composite material made of metallic particles and a binder material;

wherein the coil has an electrically insulating layer covering its surface area; and wherein core particles are magnetically aligned with the H-field of the coil.

6. The inductor according to claim 5, wherein the core has a toroid shape covering the coil.

7. The inductor according to claim 5, wherein the coil is arranged in an optimal position to provide the same magnetic flow in the core material in all directions seen from the coil surface (the same volume in all directions), by having the same cross sectional area of the core on the inside of the coil towards the center axis as on the outside of the core, seen in a cross section along a plane perpendicular to the center axis through the center of the coil.

8. The inductor according to claim 5 wherein the core comprises surface increasing structures modifying the toroidal shape to increase the surface area.

* * * * *